US006163896A

United States Patent [19]

Lee

[11] Patent Number: 6,163,896

[45] Date of Patent: Dec. 26, 2000

[54] AUXILIARY STALL SHOWER STRAINER

[76] Inventor: Bing Wang Lee, 4651 Maritime Loop, Union City, Calif. 94587

[21] Appl. No.: 09/488,007

[22] Filed: Jan. 20, 2000

[51] Int. Cl.[7] ..... E03L 1/26

[52] U.S. Cl. ..... 4/289; 4/286; 4/292

[58] Field of Search ..... 4/286–292

[56] References Cited

U.S. PATENT DOCUMENTS 1,935,128 5/1933 Pullman ..... 4/288
2,094,286 9/1937 Vogt ..... 4/289
3,570,022 3/1971 Nealy ..... 4/288

*Primary Examiner*—Henry J. Recla
*Assistant Examiner*—Tuan Nguyen
*Attorney, Agent, or Firm*—Linval B. Castle

[57] ABSTRACT

An auxiliary strainer that covers the large openings of a stall shower drain strainer that will protect against the loss of earrings and small valuables in the shower as well as protect against broken toes and fingers of curious children. The strainer with approximately 160 holes of ⅛ inch plus a larger center resilient hole is snapped to a ball on the end of a weighted rod that drops into the existing shower drain strainer.

3 Claims, 3 Drawing Sheets

AUXILIARY STALL SHOWER STRAINER

BRIEF SUMMARY OF THE INVENTION

This invention relates to plumbing fixtures and in particular to a novel removable strainer with small openings that is positioned over a fixed stall shower drain strainer with large openings to prevent loss of hair pins and other small items.

The modern stall shower has a drain generally centered in the floor pan and covered with a coarse strainer having a matrix of ¼ to ⅜ inches square openings. This will easily pass hair and debris which could clog some drain systems, but could also result in a broken toe of a child who caught a toe in the strainer, or the finger of a curious child. The modern shower strainers are also coarse enough to pass a small earring that may drop off during a shower.

To overcome the problems without replacing the stall shower drain strainer, I have developed an auxiliary strainer with many small openings that is placed on top of the drain strainer and is held down against it by gravity.

Briefly described the auxiliary strainer is preferably a plastic disc with a slight dome shape and a matrix of approximately 160 ⅛ inch holes around a ¼ inch central opening. The auxiliary strainer is held down against the shower drain strainer by a ¼ inch rod with a spherical ball at one end that has a slightly larger diameter than the central opening in the auxiliary strainer so that the spherical ball can snap into the central opening and attach the weighted rod to the bottom surface of the plastic strainer. The strainer with weighted rod attached is then dropped through a center square opening of the shower drain strainer.

BRIEF DESCRIPTION OF THE DRAWINGS

In the drawings that illustrate the preferred embodiment of the invention.

DETAILED DESCRIPTION

Figure 1:
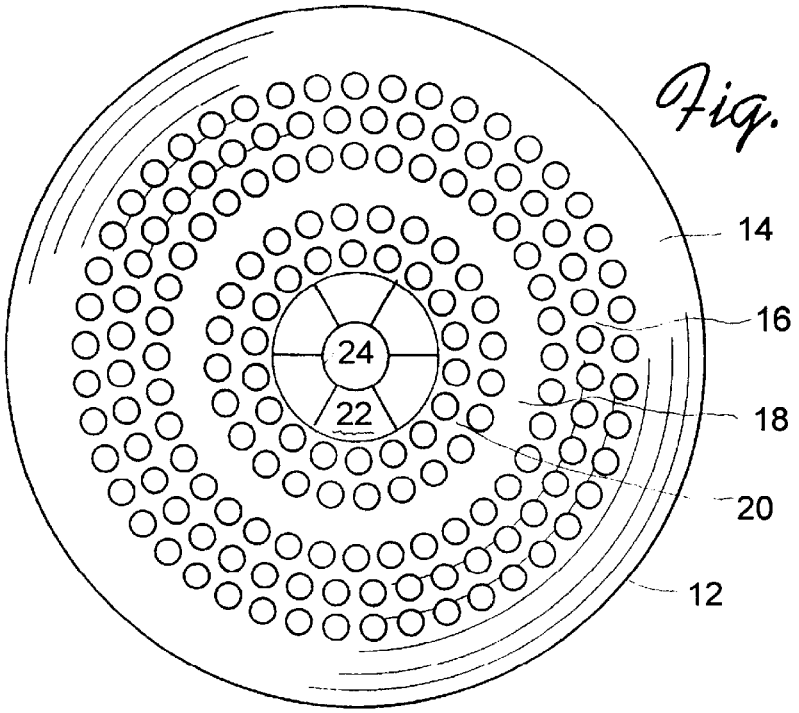
FIG. 1 is a plan view illustrating the auxiliary strainer.
Figure 2:
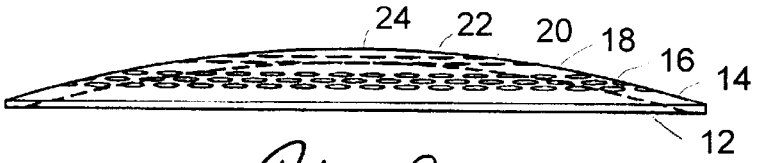
FIG. 2 is a side elevational view of the auxiliary strainer.

The auxiliary strainer is preferably formed of plastic sheeting approximately 0.8–1 mm in thickness and, as shown in FIG. 1, is circular in shape approximately four inches in diameter or slightly larger than the diameter of the shower drain strainer that it is to cover. As shown in FIG. 2, the strainer is slightly domed to provide a small space under the lower surface and between the strainer and top of the shower drain strainer as will be later explained.

As illustrated in FIG. 1, the auxiliary strainer 12 preferably has an outer circular solid band 14 approximately ½ inch wide around three circular rows 16 of ⅛ inch holes. The three circular rows 16 border a narrow inner circular solid band 18 of about 3⁄16 inches wide which adds some rigidity to the central part of the circular strainer. The band 18 borders two circular rows 20 of ⅛ inch holes which border the center section 22 of the auxiliary strainer 12. It has a total of approximately 160 holes ⅛ inch in diameter.

The center section 22 of the auxiliary strainer 12 includes only a central circular hole 24 having a diameter slightly less than the diameter of the spherical mounting ball on the end of the weighted rod. The center section 22 has a plurality of equally spaced cuts through the plastic sheet of the strainer that radially extend from the central hole 24 so that the diameter of the hole 24 may be temporarily enlarged to snap in, or out a spherical mounting ball.

It is important that, in use, the auxiliary strainer be secured over the shower drain strainer. Some shower drain strainers are cast with ferrous materials and an auxiliary strainer may made to adhere to them by cementing a magnet to the bottom surface of the auxiliary strainer. Most modern shower drain strainers, however, are made of chrome plated brass or other non-ferrous alloy and require a different securing method.

Figure 3:
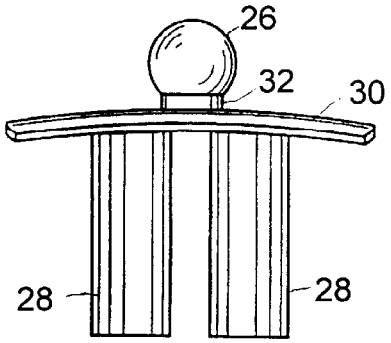
FIG. 3 is an elevational view of a spherical ball with two spaced rods for drain strainers that have no central square opening.
Figure 4:
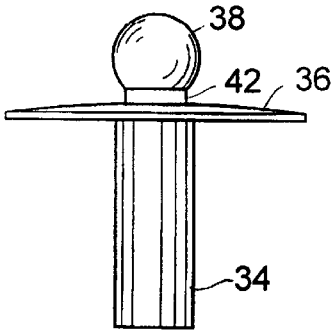
FIG. 4 is an elevational view of a spherical ball with a single rod weight for drain strainers that have a central square opening.
Figure 5:
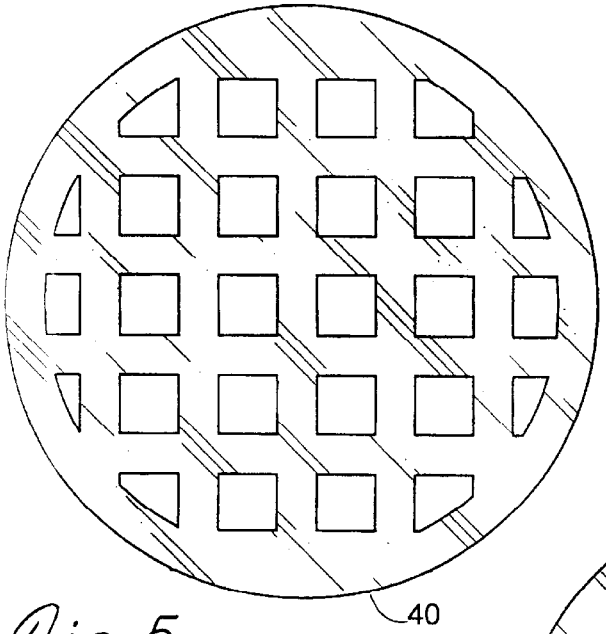
FIG. 5 is a plan view of a drain strainer with no central square opening.
Figure 6:
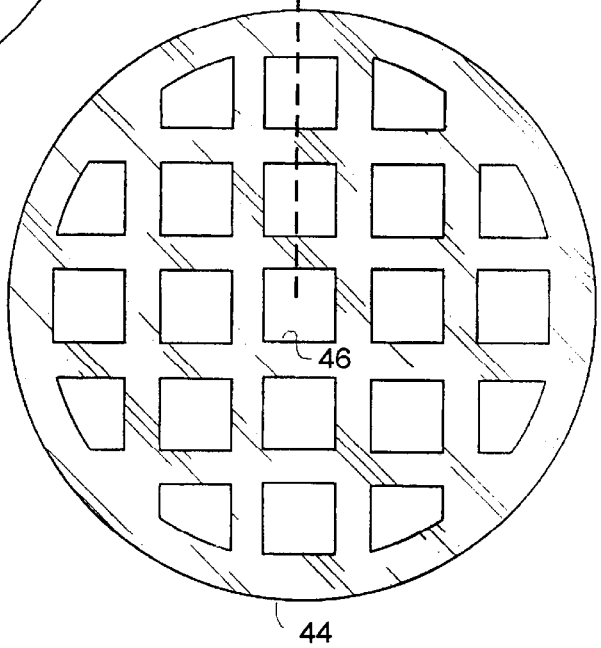
FIG. 6 illustrates the insertion of the two rods of FIG. 3 through a drain strainer of FIG. 5.
Figure 6:
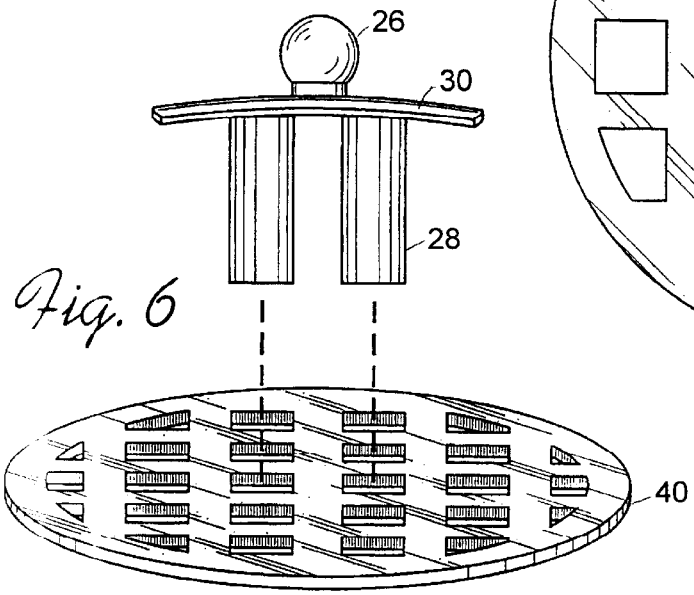

FIG. 3 and FIG. 4 illustrate two models of the weighted rods with a spherical ball 26 at one end. FIG. 3 illustrates a model having two parallel spaced rods 28, each approximately ¼ inch in diameter and about one inch in length and formed of a non-oxydizable alloy. The rods 28 are attached to a yoke 30 and centered on the yoke and between the rod ends is a spherical ball 26 on a short pedestal 32 having a diameter substantially equal to the diameter of the central hole 24 and a height equal to the thickness of the auxiliary strainer at its central opening. The spacing of the rods 28 should equal to the widths of the solid material between two adjacent openings because, in some shower drains the strainers have no central opening as shown in FIG. 5, and the rods must drop between the spaced openings in a shower drain strainer 40 to center the spherical ball 26 as illustrated in FIG. 6.

Figure 7:
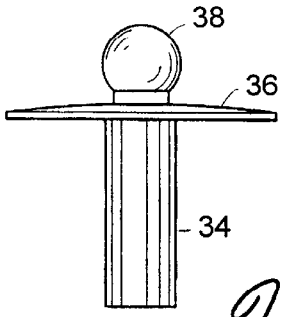
FIG. 7 illustrated the insertion of the rod of FIG. 4 through a drain strainer with a square central opening.

FIG. 4 illustrates a single weighted rod 34 with a convex washer 36 secured to a spherical ball 38 on a short pedestal 42 at one end. The embodiment of FIG. 4 is easier to use than that of FIG. 3 but it requires a shower drain strainer 44 with a ¼ inch opening 46 in the center of the strainer as shown in FIG. 7.

Figure 8:
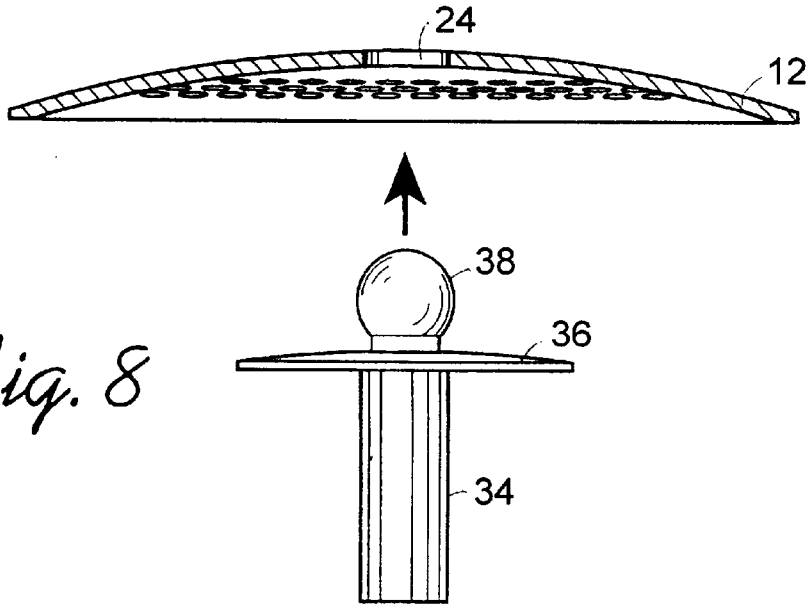
FIG. 8 is a sectional view of an auxiliary strainer and a single weighted rod.
Figure 9:
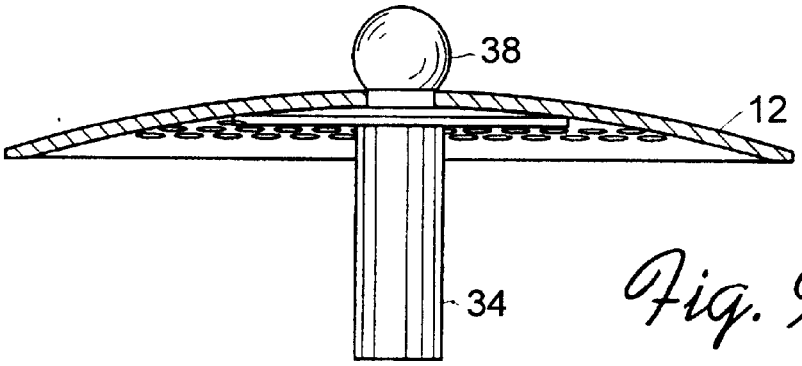
FIG. 9 illustrates the rod of FIG. 8 installed on the auxiliary strainer.
Figure 10:
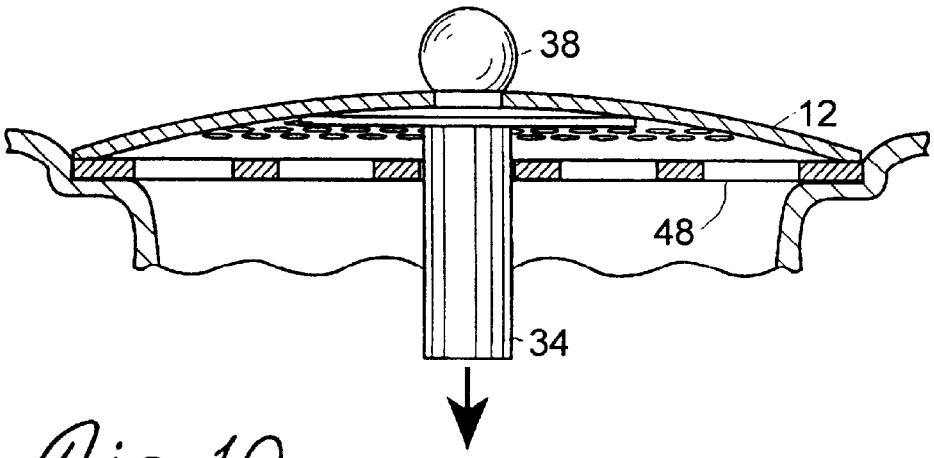
FIG. 10 is a sectional view illustrating the auxiliary strainer of FIG. 9 covering a shower drain strainer.

FIGS. 8–10 illustrates the attachment of a weighted 34 rod to a auxiliary strainer 12 and the installation to a shower drain strainer 46 having a central opening. Because of the radial cuts around the central hole 24 of the auxiliary strainer 12 the diameter of the central hole which is slightly smaller than the diameter of the spherical ball 38 at the end of the weighted rod 34 may be sprung open so that the ball 38 may be snapped into the hole ad shown in FIG. 9. The auxiliary strainer 12 is slightly arched as illustrated so that there is adequate space for the convex washer 36 that separates the spherical ball 38 from the end of the rod 34.

FIG. 10 shows how the assembled auxiliary strainer unit is installed in a shower drain strainer 48.

I claim:

1. A removable, small-hole auxiliary strainer for shower drain strainers having large openings, said auxiliary strainer comprising:

a circular disc having a diameter at least equal to the diameter of the shower drain strainer, said disc having a slight domelike shape and having a resiliently expandable central hole surrounded with approximately 160 holes, each approximately ⅛ inches in diameter;

weighted means having a spherical ball centered at one end, the diameter of said ball being slightly larger than said central hole in said circular disc, the diameter of said weighted means being sufficiently small to enable said weighted means to pass through the openings of the shower drain strainer;

whereby said expandable central hole of said circular disc is snapped over said spherical ball and said weighted means is dropped through an aperture of a shower drain strainer.

2. The auxiliary strainer claimed in claim 1 wherein said weighted means comprises a metallic rod having a diameter suitable for passage through a central opening of a shower drain strainer, said rod having said spherical ball mounted on a convex washer on one end thereof.

3. The auxiliary strainer claimed in claim 1 wherein said shower drain strainer has no central opening, said weighted means comprises two parallel metallic rods each having a diameter that will pass through spaced openings around a center of a shower drain strainer, each rod connected at one end to a yoke that is suspended at its center by said spherical ball.

* * * * *